US008434673B2

(12) United States Patent
Johnson

(10) Patent No.: US 8,434,673 B2
(45) Date of Patent: May 7, 2013

(54) TAMPER EVIDENT ENCLOSURE FOR THE STORAGE AND TRANSPORT OF DOCUMENTS

(75) Inventor: Duncan Johnson, Coventry (GB)

(73) Assignee: Volumatic Limited, Coventry (GB)

( * ) Notice: Subject to any disclaimer, the term of this patent is extended or adjusted under 35 U.S.C. 154(b) by 664 days.

(21) Appl. No.: 12/532,481

(22) PCT Filed: Mar. 25, 2008

(86) PCT No.: PCT/GB2008/001024

§ 371 (c)(1),
(2), (4) Date: Jan. 25, 2010

(87) PCT Pub. No.: WO2008/114038

PCT Pub. Date: Sep. 25, 2008

(65) Prior Publication Data

US 2010/0193582 A1 Aug. 5, 2010

(30) Foreign Application Priority Data

Mar. 22, 2007 (GB) ..... 0705496.8
Dec. 14, 2007 (GB) ..... 0724377.7

(51) Int. Cl.
*A45C 1/12* (2006.01)

(52) U.S. Cl.
USPC ..... 232/1 D; 232/15; 220/345.2

(58) Field of Classification Search ..... 232/1 D, 232/15–16, 31–32, 43.2; 194/350, 351, 202, 194/206; 109/52, 47; 206/807, 1.5; 220/23.89, 220/345.2
See application file for complete search history.

(56) References Cited

U.S. PATENT DOCUMENTS

| | | | | |
|---|---|---|---|---|
| 5,161,736 | A * | 11/1992 | Roccoberton et al. | 232/15 |
| 5,533,605 | A * | 7/1996 | Mays et al. | 194/206 |
| 5,611,483 | A | 3/1997 | Sciortino | |
| 5,715,923 | A * | 2/1998 | Dekker et al. | 194/206 |
| 5,850,966 | A * | 12/1998 | Siler et al. | 232/15 |
| 5,890,439 | A * | 4/1999 | McGunn | 109/47 |
| 6,953,148 | B2 * | 10/2005 | Esakov et al. | 232/30 |
| 7,059,599 | B2 * | 6/2006 | Lewis | 271/213 |
| 7,819,306 | B2 * | 10/2010 | Williams et al. | 232/1 D |
| 7,909,198 | B2 * | 3/2011 | Lewis | 220/345.2 |

FOREIGN PATENT DOCUMENTS

| | | |
|---|---|---|
| EP | 1503351 | 2/2005 |
| FR | 2836675 | 9/2003 |
| GB | 2437677 | 10/2007 |
| WO | 02/19289 | 3/2002 |
| WO | 2006/072781 | 7/2006 |

OTHER PUBLICATIONS

Search Report for corresponding British Application No. GB0724377.7 dated Mar. 27, 2008.

(Continued)

*Primary Examiner* — William L. Miller
(74) *Attorney, Agent, or Firm* — Caesar, Rivise, Bernstein, Cohen & Pokotilow, Ltd.

(57) ABSTRACT

An apparatus for storage and transport of documents such as bank notes, visa slips, gift tokens, checks and the like is disclosed. The apparatus comprises a frame spanned by flexible material and a cover plate slideable therealong to close the frame, the cover plate having a leading edge comprising a first member shaped to form an irreversible lock with a correspondingly shaped second member on the frame.

15 Claims, 14 Drawing Sheets

OTHER PUBLICATIONS

Search Report for corresponding British Application No. GB0724377.7 dated Aug. 20, 2008.

International Search Report for corresponding PCT Application No. PCT/GB2008/001024 dated Jul. 22, 2008.

* cited by examiner

TAMPER EVIDENT ENCLOSURE FOR THE STORAGE AND TRANSPORT OF DOCUMENTS

CROSS-REFERENCE TO RELATED APPLICATIONS

This application is a national stage application that claims the benefit under 35 U.S.C. §371 of International Application No. PCT/GB2008/001024 filed on Mar. 25, 2008, which in turn claims priority to British Application No. 0705496.8 filed on Mar. 22, 2007 and to British Application No. 0724377.7 filed on Dec. 14, 2007.

BACKGROUND OF THE INVENTION

This invention relates to a tamper-evident enclosure for the storage and transport of documents such as bank notes, visa slips, gift tokens, cheques and the like.

Typically, at a point of sale such as a cashier's desk in a supermarket, a container is suspended beneath the desk for the intermittent reception of bank notes. It may be used to store notes as they are taken from customers, and/or as an "overflow" for a till on or in the desk. When the pile of notes of a particular denomination in the till reaches a given level it may be transferred to the container, which offers better security than the till. Periodically the loaded containers are taken by security personnel to a bank, or more usually they are taken by the staff to a central counting room, where the money is counted and bagged for transport to the bank.

Some containers currently in use are rigid boxes which slide into and out of guides beneath a counter whereby they are supported. Provision is normally made for locking them in position. The front face of a container is upwardly inclined and has an exposed top opening through which one or more notes can be inserted. Behind the inclined front face is a barrier with a central, vertical slot. A plunger mechanism hinged near the bottom of the barrier can be manipulated, when notes have been inserted, to push them through the slot into the body of the container.

Containers of this kind have numerous drawbacks. They are expensive to produce and are not adequately tamper proof. Money behind the slotted barrier is still accessible through the opening and can be "fished" using, for example, adhesive tape. The relatively clumsy plunger mechanism can trap fingers and damage nails.

Another type of apparatus is a container as described in our patent application number PCT/GB01/03831 (published as WO 02/19289). The application describes a rigid frame spanned by flexible material, the frame having parallel sides provided with channels which receive side edges of a cover plate. The cover plate is slideable along the channels to close the frame and has a leading edge comprising a tongue which enters a correspondingly shaped flexible hollow formation on the frame. The arrangement is such that when the cover plate fully closes the frame the tongue is locked in the formation. The plate can be removed only by breaking the tongue. This provides immediate evidence of tampering.

No container, however strong, will withstand a determined attempt to breach it. All that is in practice necessary is to be able to determine immediately and with certainty that a breach has occurred so that the culprit can be apprehended and identified and/or to ensure that appropriate accounting adjustments are made to compensate for the breach.

SUMMARY OF THE INVENTION

It is as a result of considering previous solutions to the problem that the present invention has been reached.

A first aspect of the invention provides apparatus for storage and transport of documents, comprising a frame spanned by flexible material and a cover plate slideable therealong to close the frame, the cover plate having a leading edge comprising a first member shaped to form an irreversible lock with a correspondingly shaped second member on the frame.

In a second aspect, the invention relates to an apparatus for storage and transport of documents, comprising a frame spanned by flexible material and a cover plate slideable therealong to close the frame, the cover plate having a leading edge comprising a first member shaped to form an irreversible lock with a correspondingly shaped second member on the frame, wherein one of the first member or second member may be preferably formed, at least in part, from a transparent material.

In a third aspect, the invention relates to an apparatus for storage and transport of documents, comprising a frame spanned by flexible material and a cover plate slideable therealong to close the frame, the cover plate having a leading edge comprising a first member shaped to form an irreversible lock with a correspondingly shaped second member on the frame, wherein the cover plate comprises a plurality of holes, the holes being formed to allow some or all of the contents to be marked in the event of tampering and prevent withdrawal of the contents therethrough.

Preferably, the frame comprises one or more resilient flaps, biased to or towards a co-planar attitude, said flaps being deflectable to allow passage of one or more bank notes or documents to be stored within the flexible material.

In a fourth aspect, the invention relates to an apparatus for storage and transport of documents, comprising a frame spanned by flexible material and a cover plate slideable therealong to close the frame, the cover plate having a leading edge comprising a first member shaped to form an irreversible lock with a correspondingly shaped second member on the frame, wherein the frame comprises one or more resilient flaps, biased to or towards a co-planar attitude, said flaps being deflectable to allow passage of one or more bank notes to be stored in the flexible material.

Preferably, the resilient flaps are attached to the frame by means of two or more tabs, where at least one of the tabs effects the attachment in a direction at an angle to the direction of attachment of the one or more other tabs. Preferably, the angle is approximately 90°. It is also preferred that the flaps comprise one or more notches adjacent to at least one of the tabs.

Preferably, stop means are provided to prevent said flaps rising above the frame.

The known prior art permits removal of the cover plate after snapping the tamper-evident means. In some aspects of this invention, by not permitting removal of the cover plate, to gain entry to the stored notes it is necessary to pierce the flexible material. This makes tampering immediately evident.

Preferably a non-leading end of the cover plate comprises engaging means to engage irreversibly with the frame and/or flexible material to lock the plate. It is preferable to engage the flexible material such that removal of the cover plate will tear or visibly mark the flexible material.

Such a mechanism is only possible when the removal of the cover plate is not required. The advantage of such a mechanism is that it provides security against gaining access by simply lifting up one end of the cover plate.

Preferably at least some of the leading and non-leading ends of the cover plate are separate components attached to the cover plate. Preferably the leading and non-leading end components comprise frangible portions. The frangible portions will snap off if any attempt is made at removing the ends of the cover plate. The tampering (whether successful or not) is then immediately evident. The first member may comprise a hollow formation.

Preferably the shaped hollow formation on the frame is shaped so as to aid insertion of the frame into a housing, for example by having or comprising chamfered sides. Preferably, one, some or all of the cover plate, the flexible material and the resilient flaps comprise a plurality of holes formed to ensure that some or all of the contents of the flexible material may be marked with a dye in the event of tampering and to preclude removal of the contents therethrough. The holes must therefore be large enough and numerous enough to allow a suitable quantity of dye to pass through, but be small enough to not allow a rolled-up bank note to pass through in the event of "fishing".

Preferably, the holes in the cover plate are arranged in a regular pattern, for instance in alternating rows of three and six holes. Alternatively, the holes in the cover plate may be arranges in an entirely random fashion.

Preferably, at least a portion of the holes comprised in the resilient flaps are arranged in one or more straight lines parallel to the longest edge of the flaps. Alternatively, at least a portion of the holes comprised in the resilient flaps are arranged in a line oblique to the longest edge of the flap.

Preferably, the flexible material comprises a bag having a lower portion and side portions, wherein the holes, if present, are formed only in the lower portion. The lower portion may comprise a plurality of panels and the holes, if present, are comprised in one, some or all of the panels. Preferably, the first or second member comprises a female portion and the second or first member comprises a male member.

One problem with placing the frame into a device designed to hold notes is that the frame is ideally held close to an adjacent surface with little space in which to insert 'fishing' means to remove notes. The close fit ensures that it is difficult properly to insert the frame and it may not be evident that it has been incorrectly inserted. Moulding the hollow formation thus provides a guide to permit correct insertion into a device. Preferably, the female portion is shaped so as to aid insertion of the frame into a housing.

Preferably, the female portion is formed, at least in part, from a transparent material. Preferably, the male member is brightly coloured to provide a strong contrast to aid detection of tampering.

Preferably, the leading and, if present, non-leading ends of the cover plate are separate components attached to the cover plate.

Preferably, the leading and, if present, non-leading end components comprise frangible portions. The frangible portions will snap off if any attempt is made at removing the ends of the cover plate. The tampering (whether successful or not) is then immediately evident. Preferably, the frame is adapted to be snap-fitted into the top of an open-topped container which is locatable in a housing. Preferably, the flexible material is a plastics material, preferably recyclable plastics material.

It should be possible to separate, e.g. by grinding, and re-use all the components in a cost-effective environmentally friendly manner.

Preferably, one or more spigots are formed on the cover plate or the frame, the spigots for receiving washers to abut the frame or the cover to prevent the cover from engaging irreversibly with the frame. Preferably, the frame comprises channels for slidably receiving the covering plate and the second member comprises covering tabs for covering some or all of the openings to the channels.

Preferably, the holes have a diameter of between 2 mm and 10 mm, say between 3 mm and 5 mm.

In a fifth aspect, the invention relates to a money storage apparatus comprising an aperture to receive apparatus as described above and means to insert documents into the apparatus received in the aperture.

Preferably, the money storage apparatus further comprises locking means, arranged to be engageable with the frame of the apparatus and to be disengageable therefrom upon insertion of a cover plate of the apparatus into said aperture.

In a preferred embodiment of the invention the frame is adapted to be snap-fitted into the top of an open-topped container which is locatable in a housing, the container being held in the housing by a catch which is disengaged by the cover plate as the latter fully closes the frame.

Alternatively, the frame of may be adapted to be snugly received in a container and held securely in the container by, inter alia, a lid.

Preferably there are hinged to parallel sides of the frame, flaps biased to remain in a co-planar attitude. Preferably stop means are provided to prevent said flaps rising above the frame, said flaps may be deflectable to allow passage of one or more bank notes to be stored in the flexible material.

A further aspect of the invention provides a method of storing documents, for example at a till, the method comprising inserting a frame spanned by flexible material into an aperture of a money storage apparatus, locating documents within said frame and inserting a cover plate into the aperture to slidably engage the frame, wherein the frame and cover plate comprise mutual locking means to irreversible secure the plate to the frame upon substantial insertion of said plate.

BRIEF DESCRIPTION OF SEVERAL VIEWS OF THE DRAWINGS

Preferred embodiments of the present invention will now be described by way of non-limitative examples with reference to the accompanying drawings, in which.

DETAILED DESCRIPTION OF PREFERRED EMBODIMENTS

Figure 1:
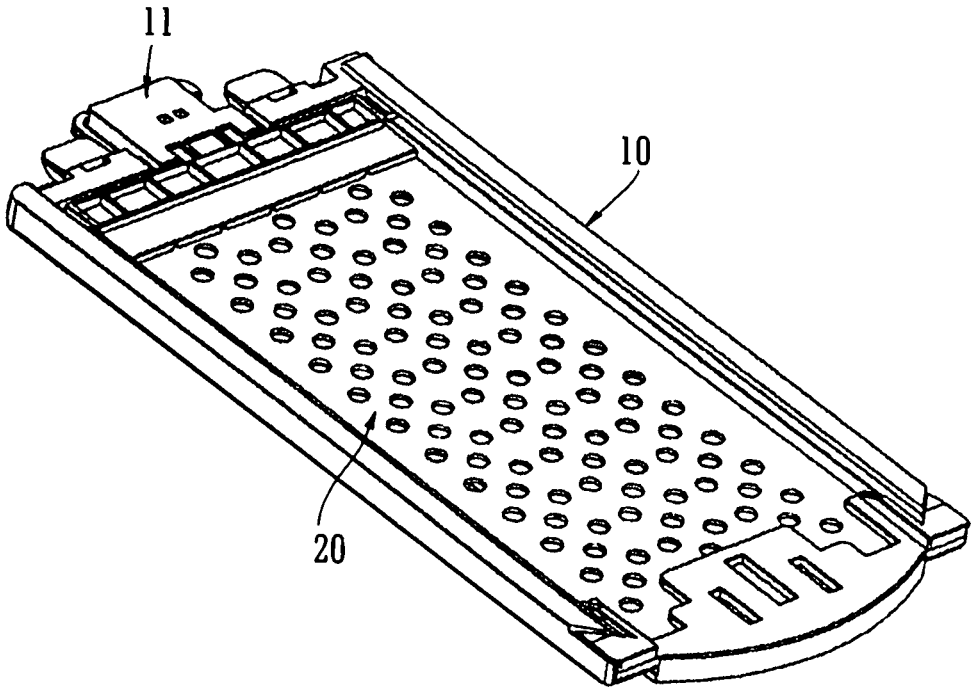
FIG. 1 is a perspective view of an enclosure of the invention.
Figure 2:
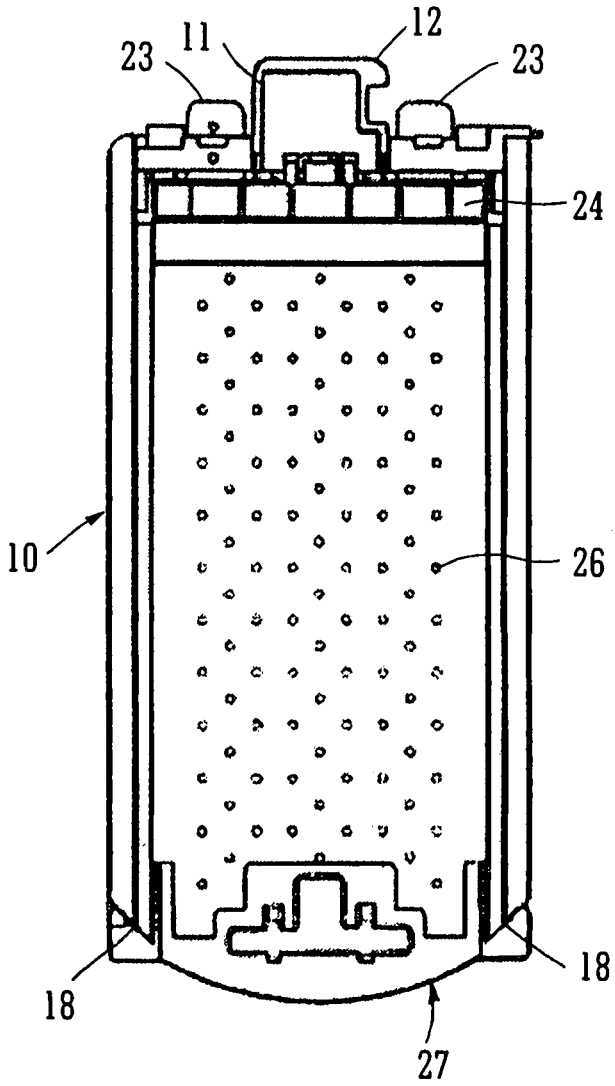
FIG. 2 is a plan view of the enclosure of FIG. 1.

Referring to FIG. 1, an embodiment of an enclosure of the present invention comprises a frame 10 holding a cover plate 20. A shaped hollow formation 11 of the frame 10 retains the cover plate 20 such that it cannot be removed. Referring to FIG. 2, holes 26 in the cover plate 20 allow for the entry of marking dyes or smoke in the event of theft.

Figure 3:
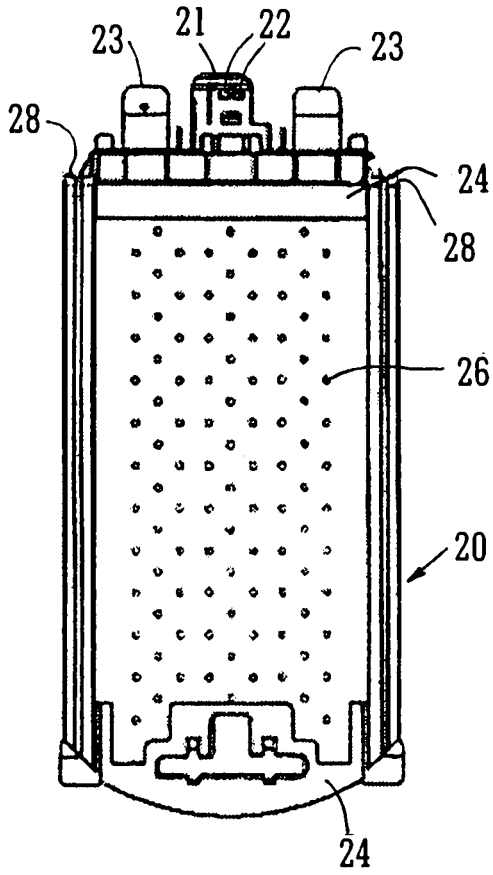
FIG. 3 is a plan view of the embodiment of FIG. 2 showing the cover plate alone.

FIGS. 2 and 3 show a version of the cover plate 20 and frame 10, respectively. Leading points 28 on the cover plate are received in channels 18 in the frame 10. The channels 18 cover the edges of the plate 20 such that the edges cannot be prised up and away from the frame 10. A tongue 21 of the plate 20 has teeth 22 which form a lock with the corresponding portion 11 of the frame 10. Portion 11 is preferably transparent so that it can be visually inspected to determine whether the lock has been properly formed or tampered with. The tongue 21 has rounded leading edges to aid insertion into the hollow formation 11.

Figure 4:
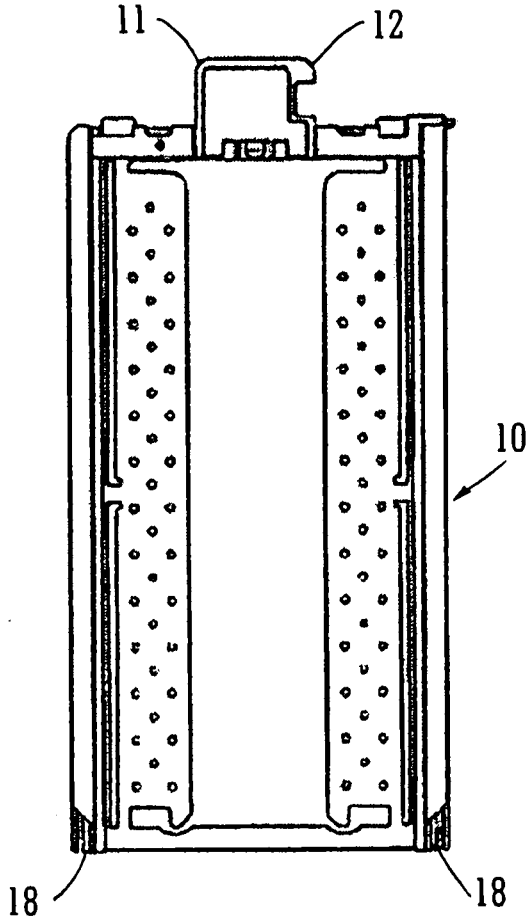
FIG. 4 is a plan view of the embodiment of FIG. 2 showing the frame alone.
Figure 5:
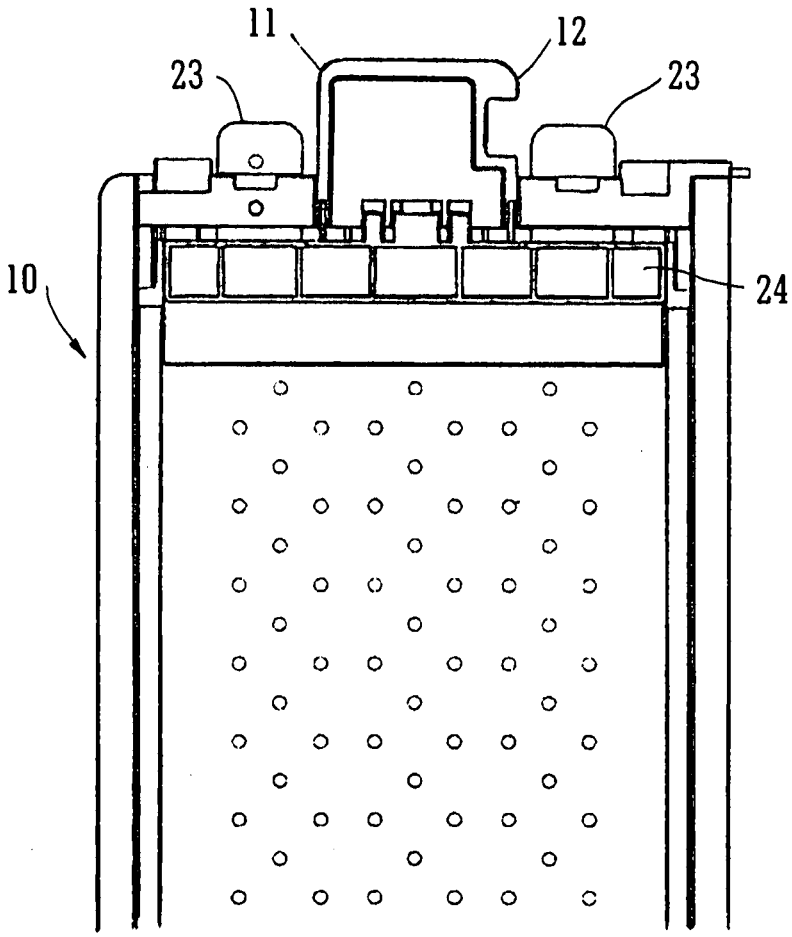
FIG. 5 is a detail of FIG. 2.

FIGS. 4 and 5 show the shaped hollow formation 11 of the frame 10 having a protrusion 12. This is designed to aid location of the frame 10 and bag within a cash receiving machine (not shown). Ideally the frame 10 cannot then be removed from the machine until completely closed by the cover plate 20. To this end, the cover plate 20 has a leading end having tabs 23 which engage with the cash receiving machine (not shown) and permit removal of the frame 10 and bag.

Once the cover plate 20 has closed the frame 10 it is not designed to be re-opened. This lock is formed by teeth 22 and the hollow portion 11 as described further elsewhere. Instead the bag (not shown) must be cut open if the money is to be removed. This means that any tampering or removal of money is immediately evident. To prevent attempts at tampering with the cover plate 20, its end portions have frangible parts 24 which will break on the application of pressure. Any attempt to prise up either end of the cover plate 20 will cause the frangible portions 24 to break and make it obvious that tampering has occurred.

Figure 6:
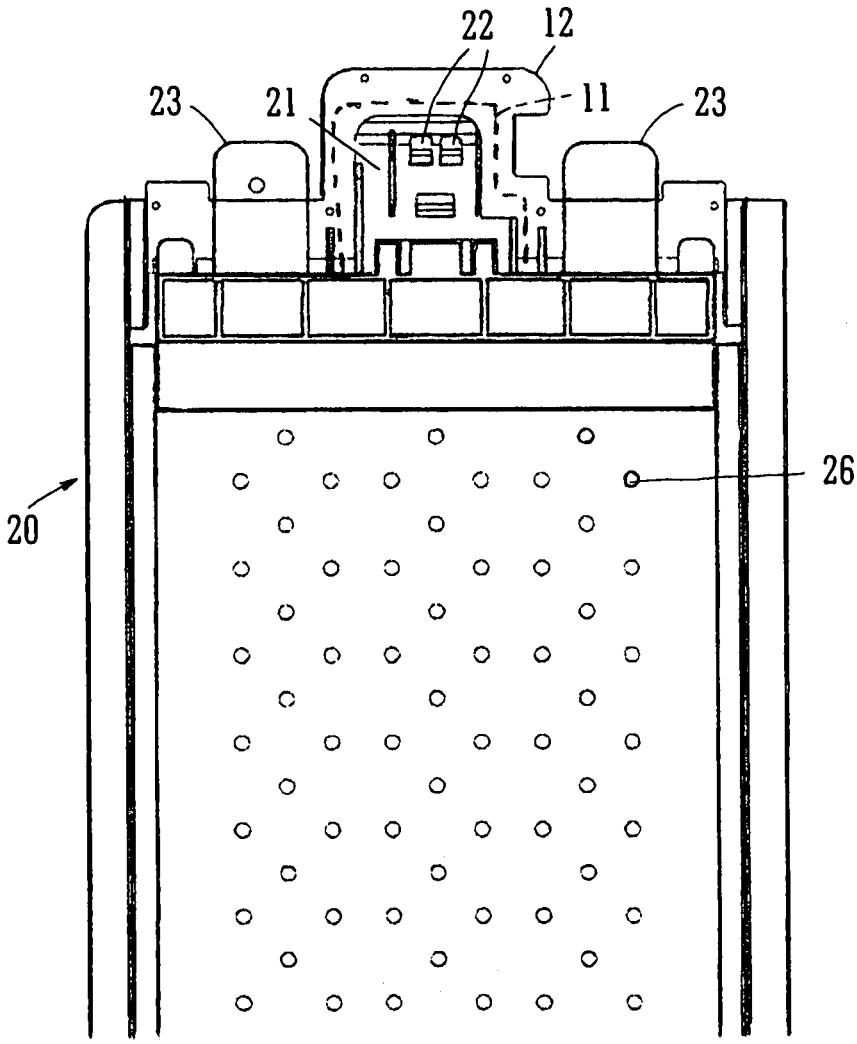
FIG. 6 is a detail of FIG. 2 showing the locking mechanism.

The locking mechanism is shown in more detail in FIG. 6. In cover plates as currently known, the cover plate is designed to be removable and held only such that any removal of the cover plate will be spotted. The aim of the present invention however is to lock the cover plate 20 irreversibly with the frame 10. To this end, the leading edge of the cover plate 20 has a tongue 21 having projections 22. These are preferably in the form of teeth. The shaped hollow formation 11 of the frame 10 is designed to receive the tongue 21 and has corresponding projections (not shown) which are designed to mesh with projections 22 of the cover plate 20 and form an irreversible lock. In a preferred embodiment, the shaped hollow formation 11 is transparent so that all projections 22 may be clearly seen. Thus, any attempted tampering/breaking of the projections will be evident. It will be appreciated that although it is desirable for the tongue 21 to fully engage the hollow formation 11, partial engagement therewith will at least cause some of the projections 22 to engage the corresponding formations, and thereby provide an irreversible lock. Of course, the more projections 22 that engage, the more secure the lock. It may also be preferable to ensure that the cover plate can only disengage a lock or catch on the cash receiving machine (not shown) in which the frame is located, and thereby allow removal of the closed frame, if the lock is fully engaged.

Figure 7:
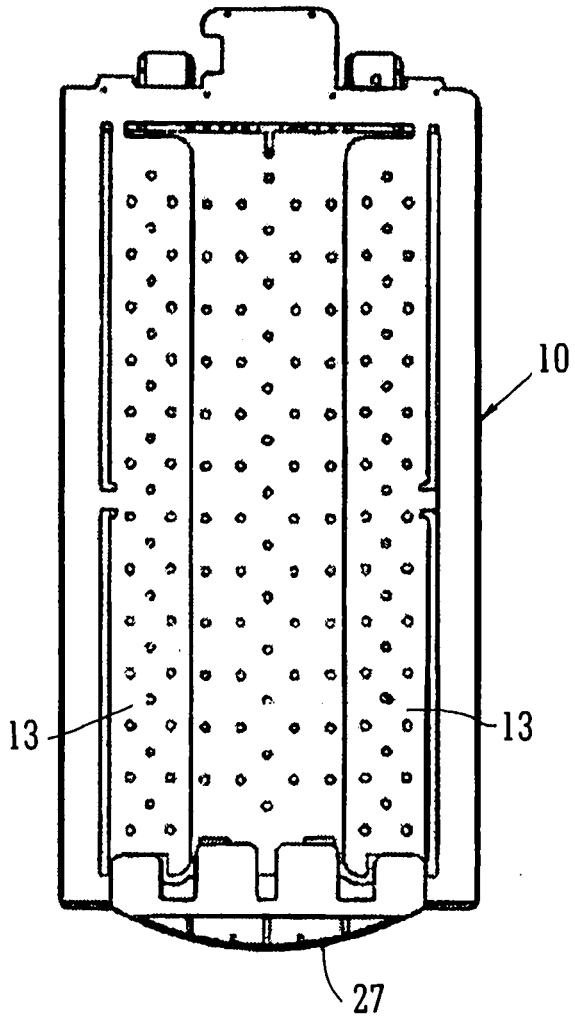
FIG. 7 is an under plan view of the embodiment of FIG. 2.

Referring to FIG. 7, the frame 10 comprises flaps 13. These are moveable to permit entry into the bag (not shown) of a bank note and act also to retain notes in said bag once it is full.

Figure 8:
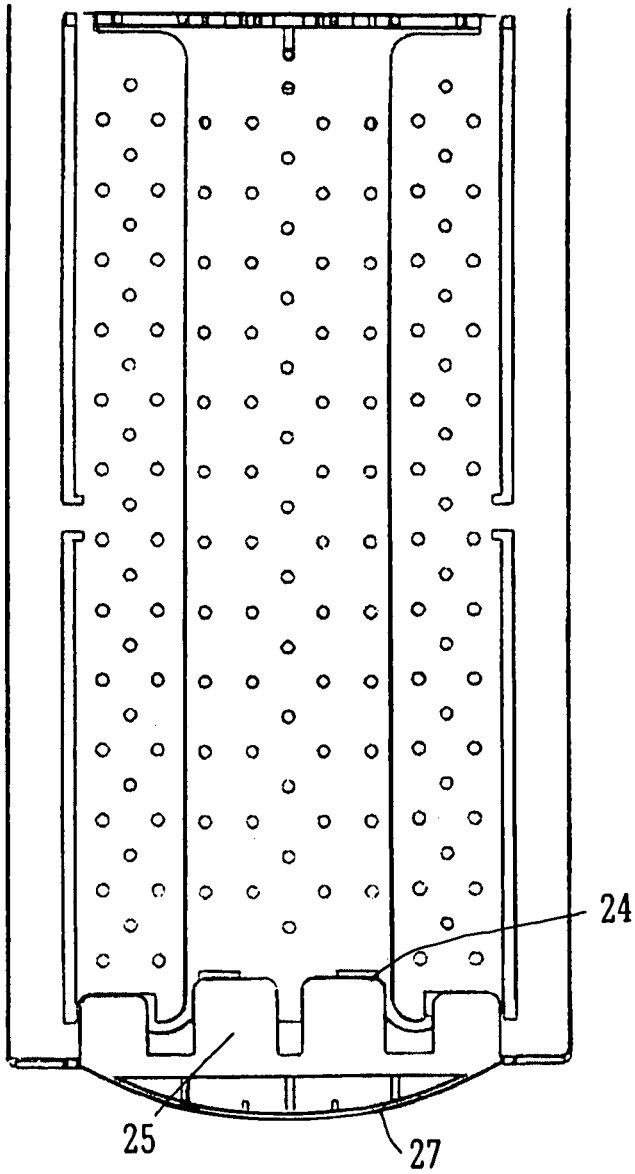
FIG. 8 is a detail of FIG. 7.

Referring then to FIG. 8, it can be seen that non-leading end 27 of the cover plate 20 comprises a further locking part 25. This is designed to lock the non-leading end 27 of the cover plate 20 to the frame 10 by means of teeth or other projections (not shown). The locking part 25 will also preferably trap a portion of the bag material (not shown) between it and the frame 10 such that any removal of the non-leading end 27 will tear the material of the bag and be obvious. This mechanism in conjunction with the frangible portions 24 ensures that any tampering (whether successful or otherwise) will be obvious.

Figure 14:
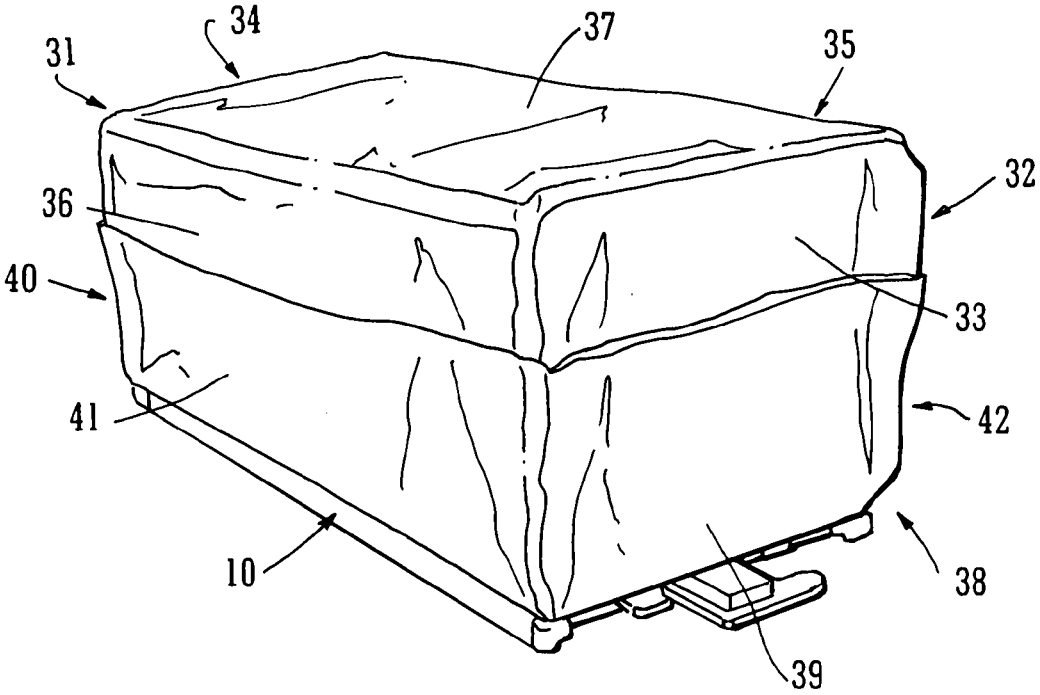
FIG. 14 shows an inverted frame according to an embodiment of the invention, having a plastic bag for receiving documents attached.

The frame 10 is designed to be used in conjunction with storage means such as a plastic bag 31. FIG. 14 shows an inverted frame 10 having a plastic bag 31 attached, the bag having a lower portion 32 and an upper portion 38.

Figure 9:
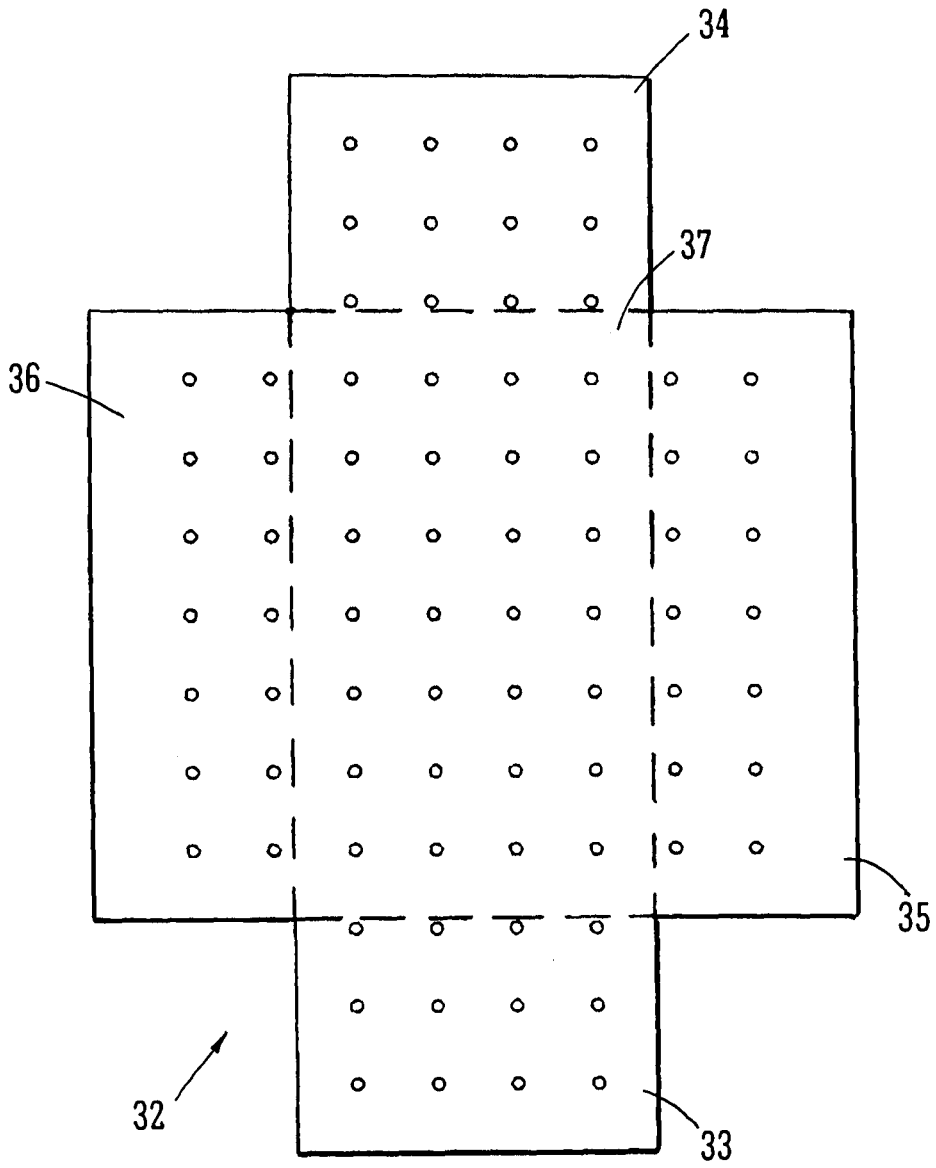
FIG. 9 shows a lower portion of a bag according to an embodiment of the invention.

FIG. 9 shows a plan view of the lower portion 32, which comprises a lower panel 37, flanked by opposing lower end panels 33, 34 and lower side panels 35, 36.

Referring again to FIG. 14, the upper portion 38 comprises a pair of opposing upper end panels 39, 40 and a pair of opposing upper side panels 41, 42. The upper end panels 39, 40 are joined by seems along opposing edges to the upper side panels 41, 42 and the lower end panels 33, 34 are joined along opposing edges to the lower side panels 35, 36. The lower portion 32 and the upper portion 38 are joined by seams along corresponding end and side panels and the upper portion 38 is joined to the frame 10.

The frame 10 and bag 31 are placed in a cash receiving machine (not shown).

Figure 10:
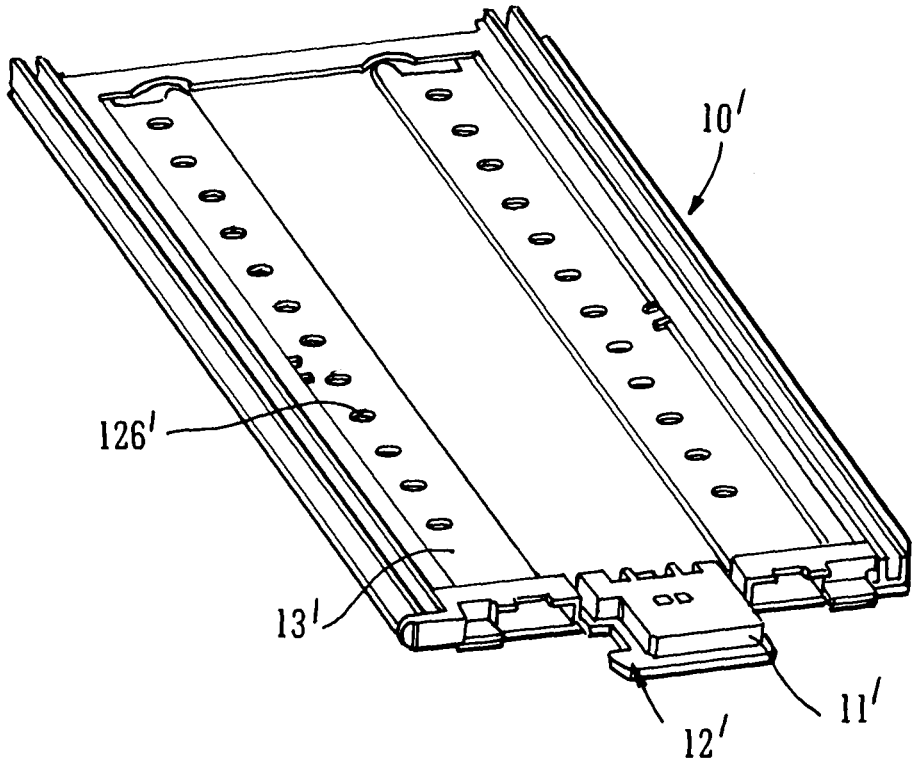
FIG. 10 shows a perspective view of a second embodiment of the enclosure of the invention having an alternative arrangement of holes in the flaps.

In another embodiment, the holes 126' in the flaps 13' are arranged in one or more straight lines parallel to the longest edge of the flap 13', as is shown in FIG. 10.

Figure 11:
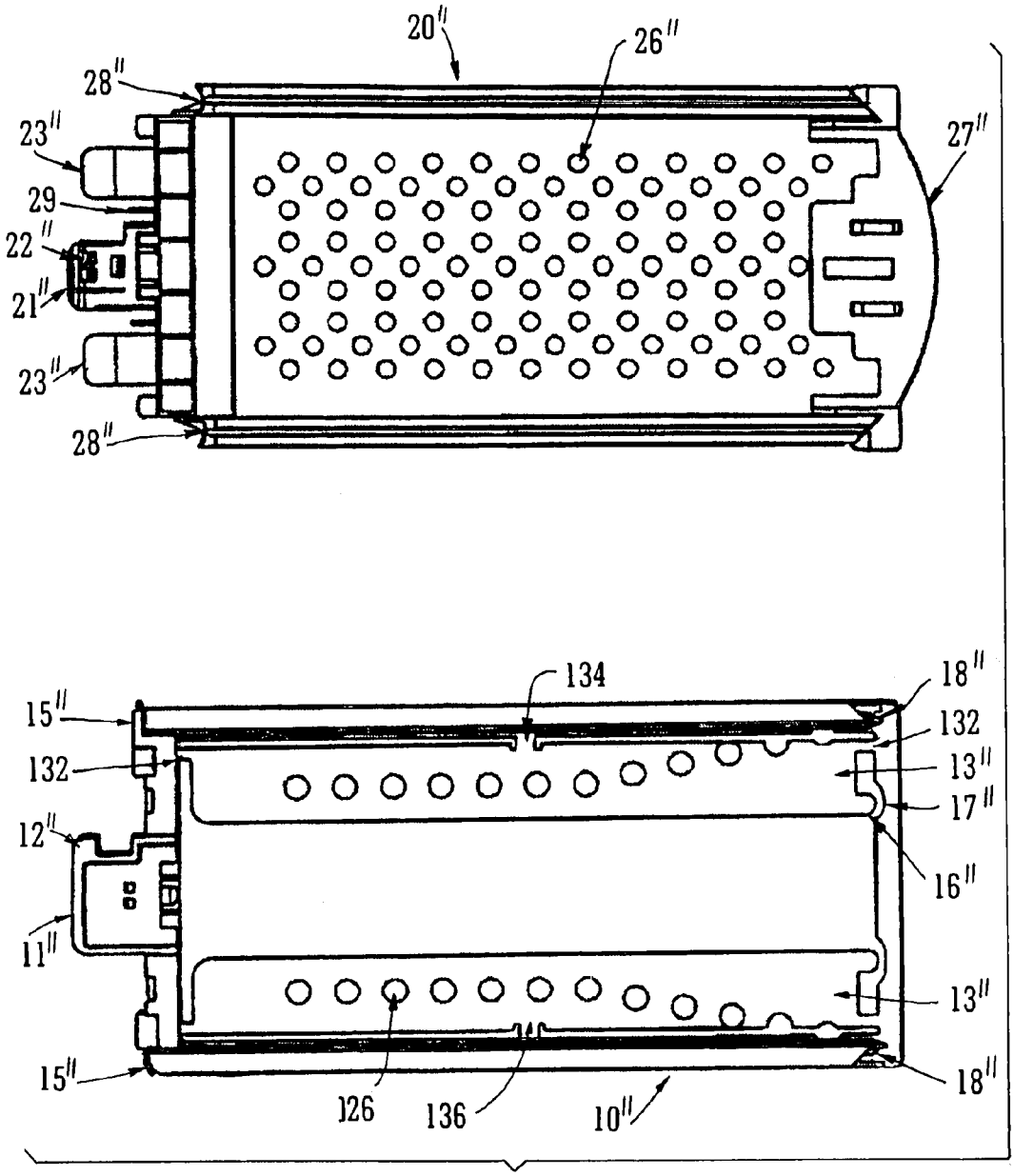
FIG. 11 is a plan view of the upper surfaces of a third embodiment of the enclosure of the invention.
Figure 12:
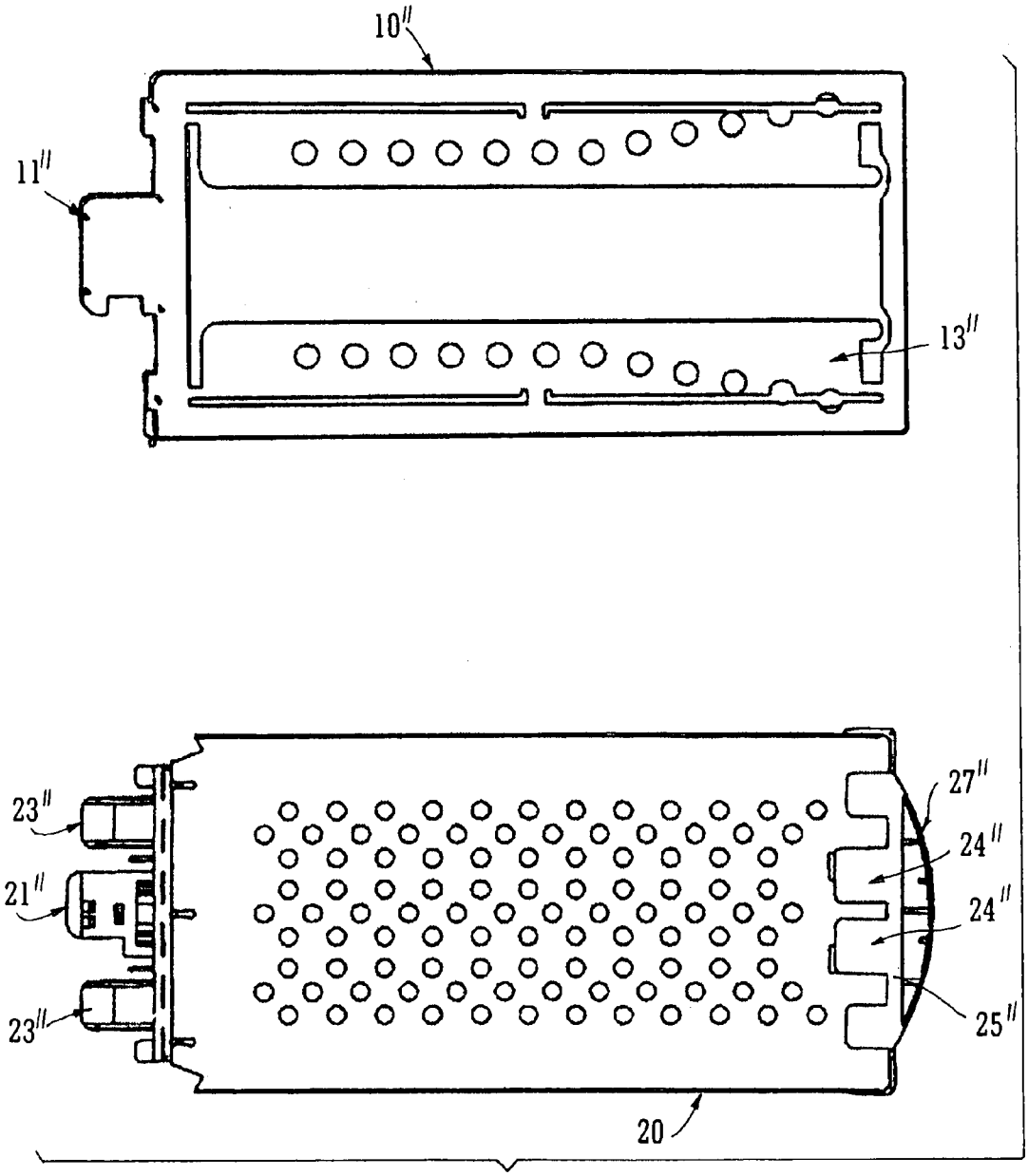
FIG. 12 is a plan view of the lower surfaces of the enclosure of FIG. 11.

FIGS. 11 and 12 respectively show upper and lower perspectives of a third embodiment of the enclosure of the invention having a cover plate 20" and frame 10". Leading points 28" on the cover plate are received in channels 18" in the frame 10". The channels 18" cover the edges of the plate 20" such that the edges cannot be prised up and away from the frame 10". A tongue 21" of the plate 20" has teeth 22" which form a lock with the corresponding portion 11" of the frame 10". The tongue 21" has rounded leading edges to aid insertion into the hollow formation 11" Portion 11" is preferably transparent so that it can be visually inspected to determine whether the lock has been properly formed or tampered with. Correspondingly, at least the tongue 21", or preferably the entire leading edge is brightly coloured to enable a strong contrast, further highlighting any tampering.

Spigots 29" protrude from the leading edge of the cover plate 20" either side of the tongue 21". These spigots 29" are received in corresponding grooves (not shown) in the hollow formation 11" when the cover plate 20" is locked in position. Washers (not shown) may be threaded onto the spigots 29" such that they may abut the hollow portion 11" to prevent the cover plate 20" from locking into position when it is not desired, for example when the enclosure is in transit before use.

The shaped hollow formation 11, 11', 11" of the frame 10, 10', 10" has a protrusion 12, 12' 12". This is designed to aid location of the frame 10, 10', 10" and bag 31, 32 within a cash receiving machine (not shown). Ideally the frame 10, 10', 10" cannot then be removed from the machine until completely closed by the cover plate 20, 20". To this end, the cover plate 20, 20" has a leading end having tabs 23, 23" which engage with the cash receiving machine (not shown) and permit removal of the frame 10, 10' 10" and bag 31, 32.

The hollow formation 11" also comprises covering tabs 15" which protrude from the side of the hollow formation 11" to cover the openings of channels 18".

Once the cover plate 20, 20" has closed the frame 10, 10', 10" it is not designed to be re-opened. This lock is formed by teeth 22, 22" and the hollow formation 11, 11', 11" as described further elsewhere. Instead the bag 31 must be cut open if the money is to be removed. This means that any tampering or removal of money is immediately evident. To prevent attempts at tampering with the cover plate 20, 20", its end portions have frangible parts 24, 24" which will break on the application of pressure. Any attempt to prise up either end of the cover plate 20, 20" will cause the frangible portions 24, 24" to break and make it obvious that tampering has occurred.

In cover plates as currently known, the cover plate is designed to be removable and held only such that any removal of the cover plate will be spotted. The aim of the present invention however is to lock the cover plate 20, 20" irreversibly with the frame 10, 10' 10". To this end, the leading edge of the cover plate 20, 20" has a tongue 21, 21" having projections 22, 22". These are preferably in the form of teeth. The shaped hollow formation 11, 11', 11" of the frame 10, 10' 10" is designed to receive the tongue 21, 21" and has corresponding projections (not shown) which are designed to mesh with projections 22, 22" of the cover plate 20, 20" and form an irreversible lock. In a preferred embodiment, the shaped hollow formation 11, 11', 11" is transparent so that all projections 22, 22" may be clearly seen. Thus, any attempted tampering/breaking of the projections will be evident. It will be appreciated that although it is desirable for the tongue 21, 21" to fully engage the hollow formation 11, 11', 11", partial engagement therewith will at least cause some of the projections 22, 22" to engage the corresponding formations, and thereby provide an irreversible lock. Of course, the more projections 22, 22" that engage, the more secure the lock. It may also be preferable to ensure that the cover plate can only disengage a lock or catch on the cash receiving machine (not shown) in which the frame is located, and thereby allow removal of the closed frame, if the lock is fully engaged.

The frame 10" comprises flaps 13". These flaps 13" are resiliently moveable to permit entry into the bag 31 of a bank note and act also to retain notes in said bag 31 once it is full. Each of the flaps 13" is attached to the frame 10" at either of its ends by means of end tabs 132 and in a central region by middle tab 134. The end tabs 132 and middle tab 134 effect the attachment in different directions, preferably at right-angles to each other, providing a strong yet resilient join. Notches 136" either side of middle tabs 134 provide additional flexibility to the flaps 13".

In some embodiments, the flaps 13" also comprise rounded protrusions 16" at one of its end edges. These protrusions usually rest in corresponding recesses 17". Optionally, the recesses 17" have chamfered sides (not shown), which allow the protrusions 16" to pass as the flaps 13" are pushed downwardly for the first time but then about the protrusions to prevent the flaps from returning to a position coplanar with the frame. This arrangement prevents the flaps 13" from being pushed upwards by the contents of the bag 31, 32, whereby the insertion of the cover plate 20, 20" could be prevented. Alternatively, the flaps may be prevented from returning to a position coplanar with the frame by a mechanism held within the cash receiving machine (not shown).

Referring to FIG. 12 in particular, it can be seen that non-leading end 27" of the cover plate 20" comprises a further locking part 25". This is designed to lock the non-leading end 27" of the cover plate 20" to the frame 10" by means of teeth or other projections (not shown). The locking part 2"5 will also preferably trap a portion of the bag 31 material (not shown) between it and the frame 10" such that any removal of the non-leading end 27" will tear the material of the bag 31, 32 and be obvious. This mechanism in conjunction with the frangible portions 24" ensures that any tampering (whether successful or otherwise) will be obvious.

Holes 126 in the cover plate 20" and the flaps 13" allow for the entry of marking dyes or smoke in the event of theft. Preferably, the holes 126 are large enough to ensure that most of the contents of the bag 31, 32 may be marked by dyes in the event of tampering, yet small enough to preclude the withdrawal of contents therethrough.

In certain preferred embodiments, holes are also provided in the bag 31, 32. Moreover, it has been surprisingly found that it is necessary to provide holes only in the lower portion 32 to effect adequate exposure of the contents of the bag 31, 32 to marking dyes in the even of tampering. Accordingly, holes may need only be provided in one, some or all of the lower end panels 33, 34, lower side panels 35, 36, or lower panel 37.

Figure 13:
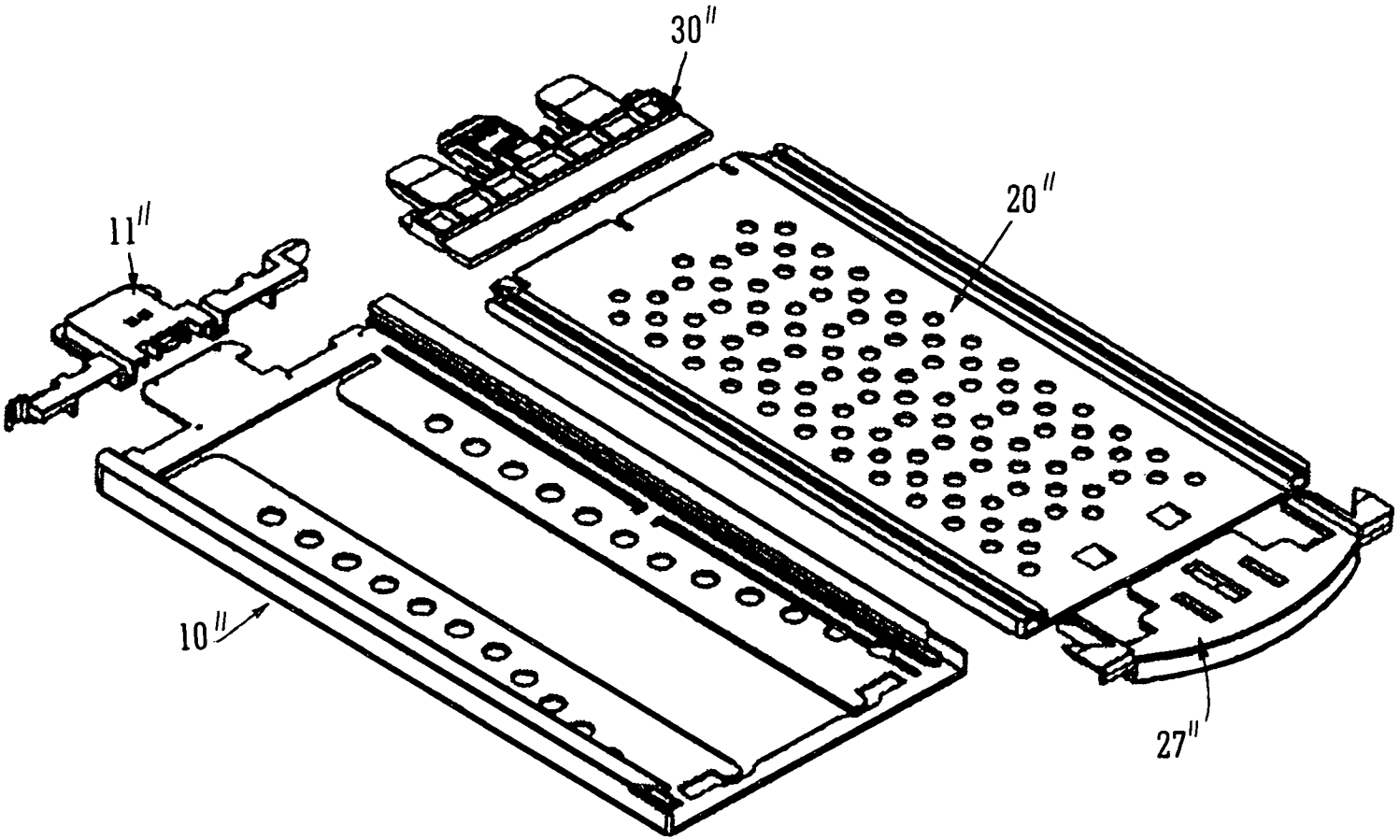
FIG. 13 is a perspective view of the enclosure of FIG. 11, separated into component parts.

In one embodiment, the holes 126 in the flaps 13" are arranged in one or more lines, where at least some of the holes 126 form a line at an angle to the longest edge of the flap 13", as is shown in FIGS. 11, 12 and 13.

In one embodiment, the holes 26, 26" in the cover plate 20, 20" form a regular pattern. Most preferably, the holes 26 form a pattern comprising alternating rows of three holes and six holes along the length of the cover plate 20. In alternative embodiments, the holes may be arranged in the cover plate in parallel or oblique lines. In further embodiments, the holes may be arranged in the cover plate in a random fashion.

In a preferred embodiment, and as shown in FIG. 13, the leading end 30" and non leading end 27" of the cover plate and the shaped hollow formation 11" of the frame 10" may be moulded separately from the frame 10" and cover plate 20" and attached thereto during manufacture. This enables the frame 10" and cover plate 20" to be made from a simple moulding, with the more complex components moulded separately and then assembled later. Moreover, the combination of separate hollow portion 11", frame 10" and leading edge 30" makes the locked portion very difficult to snap off. In contrast, apparatus according to the prior art are fabricated such that snapping off of the locking portion is easy. The separate components may be attached by any suitable means such as is known in the art.

All components including the bag 31, 32 may be made of plastics materials, preferably recyclable plastics materials. In some preferred embodiments, the components are made from different colour materials to promote ease of sorting before recycling.

It will be appreciated that although only a few particular embodiments of the invention have been described in detail, various modifications and improvements can be made by a person skilled in the art without departing from the scope of the present invention. For example, the location of the hollow formation and tongue may be reversed. Furthermore, the various features described above can be employed together or separately in any desirable combination, whether specifically described as such above or not.

While the invention has been described in detail and with reference to specific embodiments thereof, it will be apparent to one skilled in the art that various changes and modifications can be made therein without departing from the spirit and scope thereof.

The invention claimed is:

1. Apparatus for storage and transport of documents, comprising a frame spanned by flexible material and a cover plate slideable therealong to close the frame, the cover plate having a leading edge comprising a first member shaped to form an irreversible lock with a correspondingly shaped second member on the frame, wherein the cover plate comprises a plurality of holes, the holes being formed to allow some or all of the contents to be marked in the event of tampering and prevent withdrawal of the contents therethrough, wherein the frame comprises channels for slidably receiving the covering plate, said channels having openings, and wherein the second member comprises covering tabs for covering some or all of the openings to the channels.

2. Apparatus according to claim 1, wherein the frame comprises one or more flaps, which may be resilient, biased to or towards a co-planar attitude, said flaps being deflectable to allow passage of one or more bank notes to be stored within the flexible material.

3. Apparatus according to claim 2, wherein said one or more flaps is provided with one or more holes.

4. Apparatus according to claim 2, wherein said one or more flaps comprises stop means for preventing said one or more flaps from rising above the frame.

5. Apparatus according to claim 1, wherein the holes have a diameter of between 2 mm and 10 mm.

6. Apparatus according to claim 5 wherein the holes have a diameter of between 3 mm and 5 mm.

7. Apparatus as claimed in claim 1 wherein a non-leading end of the cover plate comprises engaging means to engage irreversibly with the frame.

8. Apparatus as claimed in claim 7, wherein said engaging means is able to engage the flexible material such that removal of the cover plate will tear or visibly mark the flexible material.

9. Apparatus as claimed in claim 1, wherein the frame is adapted to be snap-fitted into the top of an open-topped container which is locatable in a housing.

10. Apparatus according to claim 1, wherein one or more spigots are formed on the cover plate or the frame, the spigots being adapted to receive washers to abut the frame or the cover to prevent the cover from engaging irreversibly with the frame.

11. Apparatus according to claim 1, wherein the first or second member comprises a female portion and the second or first member comprises a male member, and wherein the female portion is formed, at least in part, from a transparent material.

12. Apparatus according to claim 1, wherein the flexible material is a plastics material.

13. Apparatus according to claim 12 wherein the plastics material is a recyclable plastics material.

14. Apparatus according to claim 1, wherein the flexible material is provided with one or more holes.

15. Apparatus according to claim 14, wherein the flexible material comprises a bag having a lower portion and a side portion and wherein the holes are comprised only in the lower portion.

* * * * *